United States Patent [19]

Cox

[11] Patent Number: 4,492,367

[45] Date of Patent: Jan. 8, 1985

[54] MAGNETIC HOLDING APPARATUS

[76] Inventor: Larry Cox, 40643 Judd Rd., Belleville, Mich. 48111

[21] Appl. No.: 101,092

[22] Filed: Dec. 7, 1979

[51] Int. Cl.[3] ..... B25B 11/00

[52] U.S. Cl. ..... 269/8; 269/41; 269/93; 269/165; 269/254 CS

[58] Field of Search ..... 269/8, 41, 254 CS, 91, 269/258, 904, 224, 221, 93, 165, 243, 208; 248/354 P

[56] References Cited

U.S. PATENT DOCUMENTS

| | | | |
|---|---|---|---|
| 1,583,611 | 5/1926 | Seely | 269/208 |
| 1,587,820 | 6/1926 | Carter | 269/249 |
| 1,913,988 | 6/1933 | Keefe | 269/243 X |
| 2,518,112 | 8/1950 | Anthony | 269/221 |
| 2,605,795 | 8/1952 | Tracy | 269/164 X |
| 2,650,523 | 9/1953 | Zwick | 269/93 |
| 3,727,884 | 4/1973 | Custer | 254/100 X |
| 3,934,316 | 1/1976 | Driscoll | 269/165 |
| 4,027,866 | 6/1977 | Ruggiera | 269/243 |
| 4,119,305 | 10/1978 | Anderson | 269/71 |

FOREIGN PATENT DOCUMENTS

| | | | |
|---|---|---|---|
| 463014 | 4/1951 | Italy | 298/354 P |
| 735365 | 8/1955 | United Kingdom | 269/208 |

*Primary Examiner*—Robert C. Watson

*Attorney, Agent, or Firm*—Basile, Weintraub & Hanlon

[57] ABSTRACT

An apparatus for holding an object, such as a furnace or kiln block, in a predetermined position relative to an external metal member, such as the metallic shell of a furnace or kiln. The apparatus includes a foot assembly which is adjustably supported on a rod member, which is in turn supported by a lower side of a magnet. The upper side of the magnet is removably magnetically affixed to the metallic shell so as to secure the apparatus thereto, thus enabling the foot assembly to hold the object against the metallic shell.

3 Claims, 5 Drawing Figures

MAGNETIC HOLDING APPARATUS

BACKGROUND OF THE INVENTION

1. Field of the Invention

The present invention relates generally to an apparatus for holding an object in a predetermined position relative to an external metal member, and methods of constructing and utilizing such an appartus.

More particularly, the invention relates to a magnetic holding apparatus for holding in place bricks or blocks used for lining or re-lining furnaces and kilns having metallic shells.

2. Description of Relevant Art

Many furnaces and kilns are conventionally constructed by initially fabricating a shell formed of steel or some other high-strength metal. The metallic shell is then lined and insulated with various refractory materials, such as fire brick, kiln brick or block, or furnace block. For example, construction of various cylindrical or rotary furnaces and kilns begins with a cylindrical steel shell. Arcuate or wedge-shaped refractory blocks or bricks are then lined along the interior of the cylindrical steel shell. A prevalent conventional technique for constructing the brick lining is to use arcuate or wedge-shaped refractory blocks which require no mortar or cement between adjacent blocks. The blocks are retained in place in the lining by the compressive force exerted when the final block is installed.

One example of a kiln or furnace which requires extensive and difficult provisions to hold the refractory brick in place during construction is known as a rotary kiln. A rotary kiln is a long tubular structure, mounted on rollers in a general horizontal orientation, with a slight slope. To contain heat in the interior of the kiln and to provide a renewable wear surface, the inner cylindrical surface of the metallic shell of the rotary kiln is lined with a multiplicity of circumferential rows of rotary kiln blocks. A rotary kiln block has the general configuration of a wedge, with one surface being arcuate to conform to the interior surface of the shell of the kiln.

In general, lining or re-lining of the upper arcuate portion of a rotary kiln or other similarly constructed kiln or furnace is performed as follows.

First, a scaffold is provided so as to afford a working support surface for construction workers within the kiln. The scaffold may be formed by wedging joist members across the interior of the kiln, and then fixing transverse plans to the joists so as to define a floor surface. Alternatively, the scaffold may take the form of a steel scaffold provided with wheels which permit the scaffold to be easily rolled along the interior of the kiln as work progresses. Generally, the scaffold is approximately eight feet in length, and is moved after approximately each six-foot longitudinal section of block-installing work has been completed.

Next, a wooden form or frame having a general semicircular configuration is disposed on the work platform or scaffold such that the arcuate portion thereof generally follows the arcuate inner upper surface of the kiln shell. Such a wooden form is conventionally known as a "center" member, and is employed to support a plurality of block-supporting devices known conventionally as "pogo sticks". The pogo sticks comprise threaded rods received within a steel pipe provided with a collar at one end thereof. A compression spring fits over the threaded rod and is supported by the collar on the steel pipe. A nut is threadedly received on the threaded rod, and by tightening or loosening the nut along the threaded rod, the overall length of the pogo stick may be adjusted. In employing the pogo stick for positioning a block against the inner surface of the kiln shell, the length of the pogo stick is suitably adjusted such that it may be wedged between the exposed lower side of the block and the upper arcuate surface of the center member.

A plethora of problems are associated with the above-described block-supporting technique for lining or re-lining the shell of a kiln. Because approximately 35 to 85 pogo sticks are commonly simultaneously supported by the center member, it is ofttimes extremely difficult to transport blocks from the forward side of the scaffold to the rear side thereof, where the block positioning work normally takes place. Another significant drawback of such conventional technique relates to safety of the workers themselves. For example, in the event that a single brick is inadvertently dropped on the wooden center member, or in the event that a single pogo stick slips out of position such tht the brick it supports drops onto the center member, other adjacent pogo sticks are likely to be struck by the falling brick. In this manner, there is a likelihood of a "chain reaction" effect, whereby more and more of the falling bricks displace more and more of the pogo sticks. Such a situation is extremely hazardous to the workers, not only with regard to the possibility that the workers will be struck by the falling bricks, but also because the scaffold may be stressed to the point of tumbling down. Furthermore, adjusting the pogo sticks to the required lengths and wedging them between the brick and the center member has proven to be a difficult and time-consuming task.

The present invention effectively solves the foregoing problems attendant the conventional technique, and provides an apparatus and method which is very easy and convenient to use, reduces working time, reduces costs, and moreover enhances the safety of the workers themselves.

SUMMARY OF THE INVENTION

The present invention provides an apparatus for holding an object in a predetermined position relative to an external metal member. The apparatus includes first means for engaging a first side of an object to be positioned, the first side being remote from an external metal member. Also provided is second means for adjustably supporting the first means so as to hold the object in a predetermined position relative to the external metal member. A third means is operably connected to the second means for magnetically securing the apparatus to the external metal member to enable the apparatus to hold the object in the predetermined position to the external metal member. The third means is disposed between the external metal member and the second means.

In a preferred embodiment of the invention, the external metal member comprises a metallic shell of a furnace or kiln, and the object to be positioned comprises a furnace or kiln block. The third means comprises a magnet having a first side thereof removably and magnetically affixed to the metallic shell, and the second means comprises a rod having a first end thereof supported by a second side of the magnet opposite the first side of the magnet.

It is a feature of the present invention to provide the aforesaid first means in the form of a foot assembly which includes a plate member adjustably supported by the rod, and fourth means for selectively fixing the plate member at a postion along the rod such that the block to be positioned is securely positioned between a protective pad provided on the plate member which engages the first side of the block, and a portion of the metallic shell which engages the second side of the block.

In accordance with another feature of the invention, the magnet member forming the above described third means of the invention may comprise either a permanent magnet or alternatively an electromagnet which is operably connected with an electric power source.

A primary object of the present invention is the provision of an apparatus and method which eminently fulfills the desideratum which has developed for a safe and convenient technique for positioning kiln or furnace blocks along the upper arcuate surface of a kiln or furnace at the time of lining or re-lining the kiln or furnace. The present invention effectively eliminates the above-described hazards and inconvenience associated with the conventional pogo stick wedging technique.

Other objects and details of the present invention will become apparent from the following detailed description, when read in conjunction with the accompanying drawings.

DETAILED DESCRIPTION OF PREFERRED EMBODIMENTS

Figure 1:
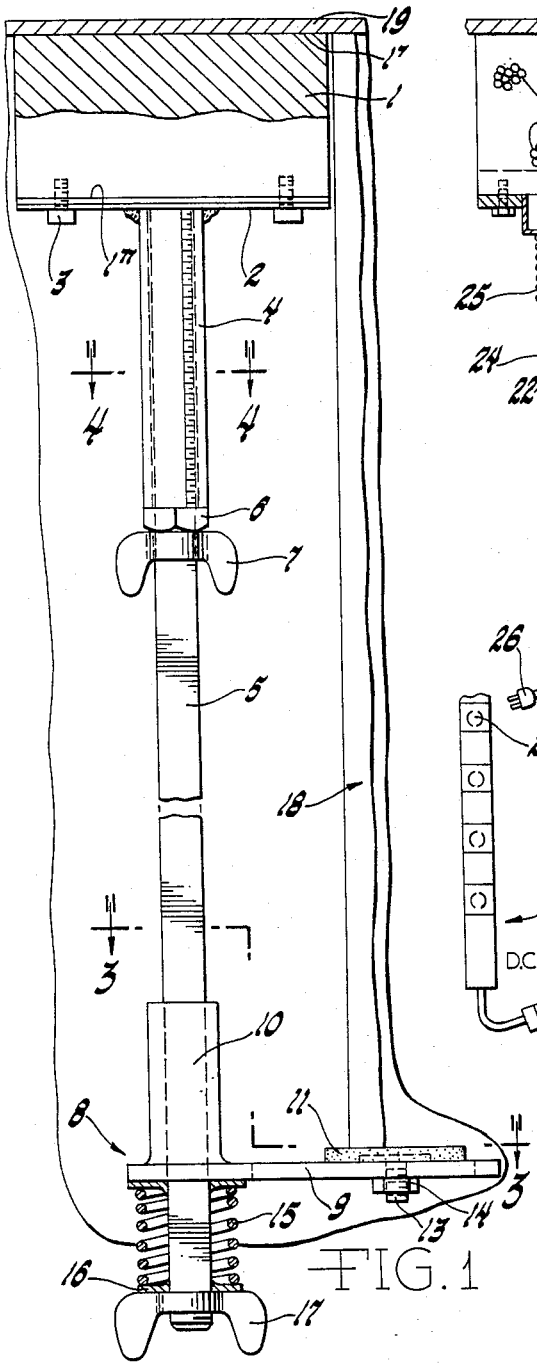
FIG. 1 depicts a front partially-sectioned elevational view of a first embodiment of the holding apparatus according to the present invention.
Figure 4:
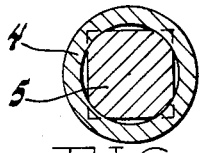
FIG. 4 is a view taken along line 4—4 in FIG. 1.
Figure 3:
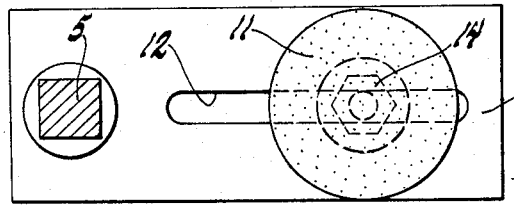
FIG. 3 is a view taken along lines 3—3 in FIG. 1.

With reference to FIGS. 1, 3 and 4, a first embodiment of the invention is shown as including a permanent magnet 1. Although the magnet 1 is depicted as having a general block-shaped configuration, it will be understood that any desired configuration may be suitably employed, although it is highly preferable that the magnet 1 include a first substantially flat side 1' and a second opposite substantially flat side 1'', for reasons which will become apparent hereinabelow. Further, because the present apparatus is particularly useful in the positioning of kiln or furnace blocks on the metallic shell of a furnace or kiln, the magnet 1 preferably has a pull strength of approximately 400 lbs. to 600 lbs., so as to afford at least a 2 to 1 safety factor in supporting an approximate load of 30 lbs.

A substantially flat plate member 2 is secured to the second side 1'' of magnet 1 by a plurality of bolts 3. Depending downwardly from plate 2 is a sleeve 4, the upper end of sleeve 4 being welded or otherwise rigidly affixed to substantially the center of plate 2. An upper first end of rod 5 is adjustably received within sleeve 4 so as to be either fully received therein or disposed therein at a desired position relative thereto. A nut 6 is disposed at the lower end of sleeve 4, and disposed immediately therebelow is a locking wing nut 7.

The rod 5 is threaded along the entire length thereof, and is preferably of a square cross-sectional configuration. Sleeve member 4 may preferably comprise a round tube provided with an internal bore of a square cross section so as to properly mate with the upper end of rod 5. However, the upper first end of rod 5 may alternatively be of a round cross section, in which event the internal bore of sleeve 4 will also be of a round cross section, although the lower portion or rod 5 is preferably limited to a square cross sectional configuration, as will be described more fully hereinbelow. In one working embodiment of the invention, the sleeve 4 was approximately 5 inches long with approximately a 9/16 inch diameter, and rod 5 was approximately 12½ inches in length. With the upper first end of rod 5 disposed within sleeve 4, locking wing nut 7 cooperates with the threads on rod 5 and with nut 6 so as to lock rod 5 at the desired positiion within sleeve 4. In this connection, it will be understood that the length of rod 5 extending from sleeve 4 is adjustably selected merely by sliding rod 5 to the desired position and then securing the locking nut arrangement. In the aforesaid working embodiment of the invention, the length adjustability of rod 5 extending from sleeve 4 was approximately 4½ inches. It is also contemplated that rod 5 may be interchangeable with a substantially identical rod which may have a length of, for example, 18 inches, for applications wherein a greater length of rod 5 is desired.

Disposed substantially adjacent a lower second end of rod 5 is a foot assembly 8. The foot assembly 8 includes an elongated plate member 9 which may be formed, for example, of cold rolled steel. An aperture is drilled in plate 9 substantially adjacent one end thereof, and a collar 10 is disposed thereover and affixed to plate 9. The collar 10 is provided with an internal bore generally of a square cross sectional configuration so as to mate with the lower square end of rod 5, and is slidably received thereover. In this manner, relative rotation between rod 5 and the foot assembly 8 is prevented. An adjustable protective pad member 11 is disposed on the upper surface of plate 9, and as shown in FIG. 3 is mounted so as to be horizontally adjustable, in the longitudinal direction of plate 9. To this end, plate 9 is provided with an elongated slot 12 adapted to slidably receive therein a bolt 13 extending from pad 11, and pad 11 is secured at the desired position along plate 11 by tightening a nut 14 received on bolt 13. The protective pad member 11 is preferably formed of rubber or the like, and is readily replaceable when worn.

A compression spring member 15 is disposed below plate member 9 and is received around the lower end of rod 5 as shown in FIG. 1. The spring 15 is held in a properly centered position via a pair of rigid spring centering washer members 16 disposed at either end thereof, and disposed immediately below the lowermost washer 16 is a locking wing nut 17 which cooperates with the threads provided on rod 5 so as to lock the entire foot assembly 8 at a desired position on rod 5.

In one working embodiment of the invention, the plate 9 had approximate dimensions of ¼ inch by 1 inch by 6 inches, and collar 10 was approximately 3 inches long. The spring member 15 was in the form of a 2-inch light spring with a 40 lbs. compression strength. Further, the sleeve 4, rod 5 and collar 10 were fabricated from 6150 steel alloy, although the present invention is not limited to such material, and it is contemplated that any suitable high-strength steel alloy or other desirable material may be employed in fabricating various components of the apparatus.

The operation of the apparatus as described hereinabove with reference to FIGS. 1, 3 and 4 is as follows. First, the user of the apparatus selects the desired approximate length of rod 5 by sliding the upper end thereof to the desired position within sleeve 4. The locking wing nut 7 is then tightened so as to fix rod 5 at the desired predetermined position. Such positioning of rod 5 within sleeve 4 will depend, of course, upon the dimensions of the block 18 or other object to be held by the apparatus.

After rod 5 has been adjusted as described hereinabove, the upper side 1' of magnet 1 is positioned against the working surface of a metallic shell 19 of a furnace or kiln, so as to magnetically secure the entire apparatus to the shell 19. With the apparatus thus positioned, the kiln or furnace block 18 will be positioned with its first or lower side engaging the upper surface of protective pad 11 disposed at the desired longitudinal position along plate 9, and a second or upper side thereof engaging a portion of shell 19 at the desired predetermined position, as shown in FIG. 1. The lower locking wing nut 17 may be threadedly adjusted along rod 5 to fix plate 9 at the desired position so as to securely hold the block 18 in place, however, such adjustment is substantially minor in comparison with the preadjusted length of rod 5 provided via locking wing nut 7 as described hereinabove. The compression spring 15 disposed between locking wing nut 17 and the lower surface of plate 8 will function to provide substantially resilient support of plate 9, and will compensate for minor size differences in various ones of the blocks 18.

It will be clear from the foregoing description of the structural and functional details of the apparatus that the block 18 will be positioned at the desired predetermined position in a very convenient and safe manner, and there will be substantially no danger of dislodging the apparatus, in contrast to the above-described conventional pogo stick arrangement, because the apparatus is entirely supported from above, via the magnet 1 affixed to metallic shell 19. Further, because the apparatus is entirely supported from above and requires no wedging or other support from below, there will be no impairment of the working area below the apparatus, also in contrast to the conventional technique.

Figure 2:
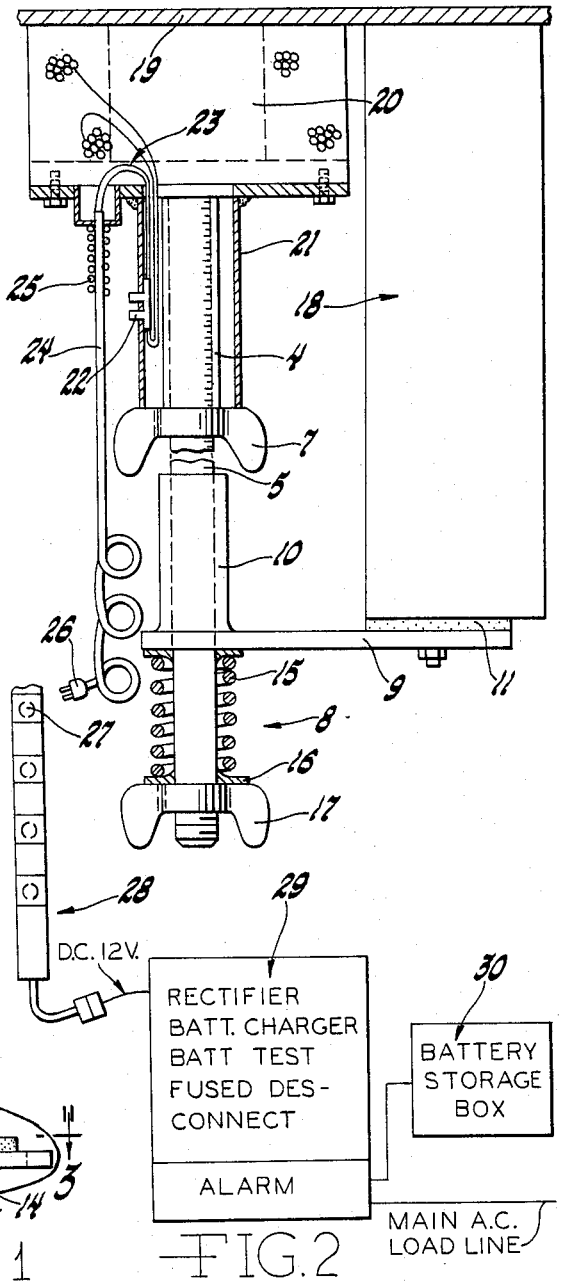
FIG. 2 illustrates a front partially-sectioned elevational view of a second embodiment of the holding apparatus according to the present invention.

With reference now to FIG. 2, there is depicted a second embodiment of the apparatus in accordance with the present invention. The foot assembly 8 employed in the FIG. 2 embodiment of the invention is substantially identical to, and interchangeable with, the foot assembly 8 described hereinabove with reference to FIG. 1, and accordingly like reference numerals have been employed to designate like parts.

In the FIG. 2 embodiment of the invention, the permanent magnet 1 of the FIG. 1 embodiment is replaced by an electromagnet 20 which is adapted to provide at least a 40 lb. pull force, for example. The structure of rod 5 and sleeve 4 is substantially the same as described hereinabove with reference to FIG. 1, except that in this embodiment sleeve 4 comprises an inner sleeve which is concentrically disposed within an outer sleeve 21. A space is defined between inner sleeve 4 and outer sleeve 21, within which space is disposed a switch 22 and a plurality of electrical conduits 23. The electromagnet 20 is operably connected with a self-coiling cord or main load line 24, the upper portion of which is circumferentially provided with a light spring member 25. The line 24 is provided at the free end thereof with a twist-lock plug member 26 adapted to be operably connected with any one of a plurality of twist lock outlets 27 provided in an extension cord 28. The extension cord 28 is preferably provided with a large number of twist lock outlets 27, e.g., 85 outlets, so that a large number of electromagnets 20 may be operably connected therewith simultaneously. The extension cord 28 is in turn operably connected with a rectifier unit 29 which converts standard 120 V or 240 V alternating current to 12 V direct current, for supplying to line 24 via extension cord 28, as shown diagrammatically in FIG. 2. The rectifier unit 29 is also preferably operably connected to a back-up safety system 30, and is desirably provided with a battery charger, battery test device, fused disconnect system, and an alarm device to indicate malfunction. It will thus be understood that electromagnet 20 is operably connected with an electrical power source which ultimately supplies a 12 V direct current to electromagnet 20 so as to energize the same.

In general, the FIG. 2 embodiment of the invention functions in much the same manner as described hereinabove with reference to FIG. 1 so as to hold a block 18 in position against a shell portion 19. Electromagnet 20 functions to magnetically affix the apparatus to shell 19 when the main line 24 is operably connected to the above-described electrical power source.

Figure 5:
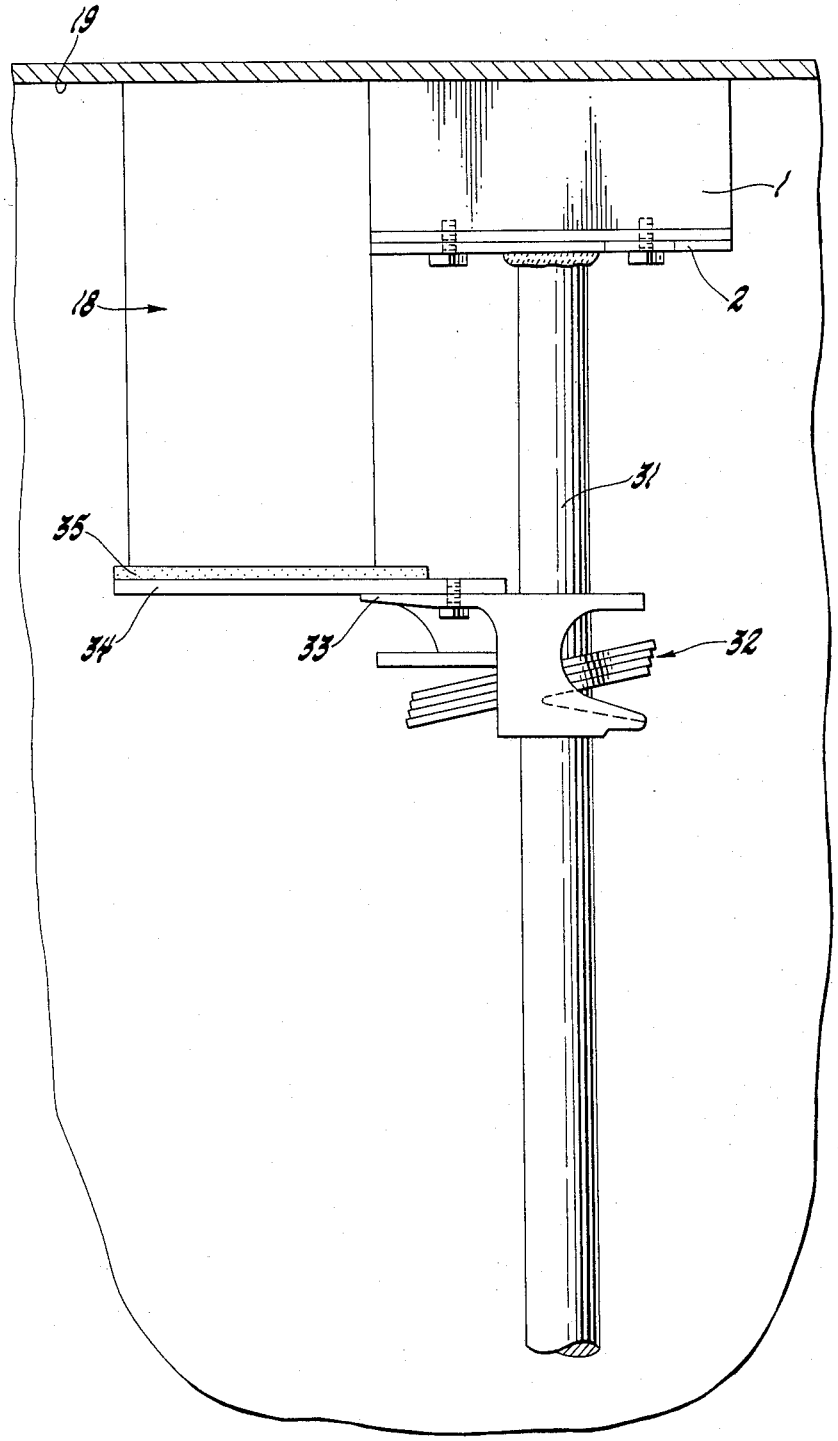
FIG. 5 is a front elevational view of a third embodiment of the holding apparatus according to the present invention.

With reference to FIG. 5, there is depicted a third embodiment of the apparatus in accordance with the present invention. As shown in FIG. 5, a permanent magnet 1 provided with bottom plate 2 bolted thereto, substantially as described hereinabove with reference to FIG. 1, supports the upper end of a rod 31. The upper end of rod 31 is welded or otherwise rigidly affixed to substantially a central portion of plate 2, and rod 31 is substantially smooth along the length thereof, in contrast to threaded rod 5. A pipe clamp unit 32 is operably received by rod 31. The pipe clamp unit 32 may take the form of an HE 22 PONY pipe clamp, such as disclosed in U.S. Pat. No. 2,815,778, and is modified at 33 so as to support in cantilever fashion a plate member 34 which is comparable in general configuration to plate 9 described with reference to FIG. 1. Plate 34 is bolted to pipe clamp unit 32 as shown in FIG. 5, and is provided adjacent the upper surface thereof with a protective pad member 35. The protective pad 35 may preferably be adjustable as described hereinabove with reference to pad 11 (FIG. 3). The pipe clamp unit 32 permits relative positioning of plate 34 at any desired height along rod 31 so as to position a block 18 as described hereinabove with reference to FIG. 1, with the lower end of block 18 engaging pad 35 and the upper end of block 18 engaging a portion of metallic shell 19.

Although there have been described what are at present considered to be the preferred embodiments of the invention, it will be understood that the present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. An apparatus for holding a furnace or kiln block in a predetermined position relative to the external metallic shell of a furnace or kiln, comprising:

a foot assembly engaging a first side of said furnace or kiln block, said first side being remote from said external metallic shell;

a rod having first and second ends for adjustably supporting said foot assembly so as to hold said furnace or kiln block in a predetermined position relative to said external metallic shell, said rod being threaded along substantially the entire length thereof;

said foot assembly including a plate member adjustably supported by said rod, said plate member being provided adjacent a first end thereof with a collar member adapted to be received about said rod;

a resilient protective pad member mounted on said plate member and adapted to engage said first side of said furnace or kiln block, said protective pad member being adjustably supported on said plate member so as to be selectively fixed at a desired position along the length of said plate member;

said foot assembly including a spring member received around said rod below said plate member, and a fastening member disposed below said spring member;

said fastening member cooperating with the threads of said threaded rod and with said spring member so as to selectively and resiliently fix said plate member at a position along said threaded rod wherein said furnace or kiln block is securely positioned between said protective pad member engaging said first side of said block and a portion of an inner surface of said metallic shell engaging said second side of said block; and a magnet operably connected to said rod for magnetically securing said apparatus to said external metallic shell to enable said apparatus to hold said furnace or kiln block in said predetermined position to said external metallic shell, said magnet being disposed between said external metallic shell and said rod and having a first side thereof removably and magnetically affixed to said external metallic shell;

said rod having a first end thereof supported by a second side of said magnet opposite said first side of said magnet;

said first end of said rod being adjustably received within a sleeve member secured to said second side of said magnet and secured at a desired position within said sleeve member by a fastening member.

2. An apparatus according to claim 1, wherein:

said magnet comprises a permanent magnet.

3. An apparatus according to claim 1, wherein:

said magnet comprises an electromagnet; and said electromagnet is operatively connected with an electrical power source.

* * * * *